US012250968B2

(12) United States Patent
Lei

(10) Patent No.: US 12,250,968 B2
(45) Date of Patent: Mar. 18, 2025

(54) ELECTRONIC ATOMIZATION DEVICE AND SMOKE-GENERATING ASSEMBLY

(71) Applicant: Shenzhen Smoore Technology Limited, Shenzhen (CN)

(72) Inventor: Guilin Lei, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 478 days.

(21) Appl. No.: 17/580,624

(22) Filed: Jan. 20, 2022

(65) Prior Publication Data

US 2022/0132921 A1 May 5, 2022

Related U.S. Application Data

(63) Continuation of application No. PCT/CN2020/098600, filed on Jun. 28, 2020.

(30) Foreign Application Priority Data

Jul. 22, 2019 (CN) ..... 201910663302.X

(51) Int. Cl.

| | |
|---|---|
| ***A24F 40/30*** | (2020.01) |
| ***A24F 40/10*** | (2020.01) |
| ***A24F 40/20*** | (2020.01) |
| ***A24F 40/485*** | (2020.01) |

(52) U.S. Cl.

CPC ..... *A24F 40/30* (2020.01); *A24F 40/10* (2020.01); *A24F 40/20* (2020.01); *A24F 40/485* (2020.01)

(58) Field of Classification Search

None

See application file for complete search history.

(56) References Cited

U.S. PATENT DOCUMENTS

| | | | |
|---|---|---|---|
| 2,533,956 | A | 12/1950 | Robertson |
| 10,194,693 | B2 | 2/2019 | Wensley et al. |
| 2014/0283824 | A1 | 9/2014 | Wheelock et al. |

FOREIGN PATENT DOCUMENTS

| | | | |
|---|---|---|---|
| CN | 103068266 | A | 4/2013 |
| CN | 104188107 | A | 12/2014 |
| CN | 104983073 | A | 10/2015 |
| CN | 204907924 | U | 12/2015 |
| CN | 206043412 | U | 3/2017 |
| CN | 206482014 | U | 9/2017 |
| CN | 107404945 | A | 11/2017 |
| CN | 107713016 | A | 2/2018 |

(Continued)

OTHER PUBLICATIONS

English machine translation of KR 102019595 B1; Lee; A24b15/167; 31 pages; Sep. 6, 2019. (Year: 2019).*

(Continued)

*Primary Examiner* — Linda L Gray

(57) ABSTRACT

Provided are an electronic atomization device (1) and a smoke-generating assembly (40), the electronic atomization device (1) comprising a baking unit (80), the baking unit (80) comprising a baking chamber (310); the electronic atomization device (1) also comprising a smoke-generating assembly (40) accommodated in the baking chamber (310); the smoke-generating assembly (40) comprising a solid smoking medium and a turbulent flow member (41) embedded in the solid smoking medium.

15 Claims, 15 Drawing Sheets

(56) References Cited

FOREIGN PATENT DOCUMENTS

| | | | |
|---|---|---|---|
| CN | 207054779 | U | 3/2018 |
| CN | 108185537 | A | 6/2018 |
| CN | 108323815 | A | 7/2018 |
| CN | 108323820 | A | 7/2018 |
| CN | 108420112 | A | 8/2018 |
| CN | 108991600 | A | 12/2018 |
| CN | 208192147 | U | 12/2018 |
| CN | 208403253 | U | 1/2019 |
| CN | 109700083 | A | 5/2019 |
| CN | 110338467 | A | 10/2019 |
| CN | 210747239 | U | 6/2020 |
| EP | 3508078 | A1 | 7/2019 |
| WO | WO2018058884 | A1 | 4/2018 |
| WO | WO2018094637 | A1 | 5/2018 |
| WO | WO2018112769 | A1 | 6/2018 |

OTHER PUBLICATIONS

English machine translation of CN-104223364-A; Zhou; A24B3/12; 19 pages; Dec. 24, 2014. (Year: 2014).*

English machine translation of CN 108323820 A; Case; A24F47/008; 17 pages; Jul. 27, 2018. (Year: 2018).*

International search report, International Application No. PCT/CN2020/098600, mailed Sep. 29, 2020 (14 pages).

Chinese First Office Action, Chinese Application No. 201910663302.X, mailed Jan. 11, 2024 (14 pages).

European search report, 20844373.9-1004/4000435 PCT/CN2020098600, mailed Dec. 8, 2022(9 pages).

Chinese Notification to Grant Patent Right for Invention, Chinese Application No. 201910663302.X, mailed Dec. 17, 2024 (5 pages).

* cited by examiner

ELECTRONIC ATOMIZATION DEVICE AND SMOKE-GENERATING ASSEMBLY

CROSS REFERENCE

The present application is a continuation-application of International (PCT) Patent Application No. PCT/CN2020/098600, filed on Jun. 28, 2020, which claims foreign priority of Chinese Patent Application No. 201910663302.X, filed on Jul. 22, 2019, the entire contents of which are hereby incorporated by reference in their entireties.

TECHNICAL FIELD

The described embodiments relate to the field of atomizers, and in particular, to an electronic atomization device and a smoke-generating assembly.

BACKGROUND

Traditional smoking ignites a tobacco via an open fire, and the tobacco is burned to produce smoke for a smoker to inhale. The smoke produced by burning the tobacco generally includes thousands of harmful substances. Therefore, traditional tobacco not only causes serious respiratory diseases to the smoker, but also easily brings harm from second-hand smoke.

SUMMARY OF THE DISCLOSURE

In order to solve the technical problem of more harmful substances produced by burning the traditional tobacco, atomized electronic cigarettes and electronic flue-cured cigarettes have been developed by technicians. However, by atomizing cigarette liquid, the atomized electronic cigarettes form smoke for the user to inhale. Although the atomized electronic cigarettes overcome the above disadvantages of traditional cigarettes and can meet consumers' dependence on the tobacco to a certain extent, the cigarette liquid of the electronic cigarettes is made of flavors and fragrances, and is not a real cigarette product. In this way, the cigarette tastes light and lacks aroma of the tobacco, therefore, the atomized electronic cigarettes cannot be widely accepted by consumers. Existing low-temperature electronic flue-cured cigarettes heats the tobacco in a low-temperature manner where the solid smoking medium is non-combustion. Due to a low heating temperature, harmful substances produced by the heating manner are reduced, but amount of the smoke is obviously insufficient. However, if the tobacco is heated at a high temperature, the tobacco is easy to be blackened and carbonized, and the heat distribution is uneven. In addition, it is easy to cause a problem that one part of the tobacco has been carbonized and the temperature of another other part of the tobacco is not enough, which also produces more harmful substances. Thus, how to absorb the aroma of the tobacco and reduce the harmful substances to a greater extent has become an urgent problem in the tobacco industry.

In the related art, except using an atomization component to atomize the liquid medium, a baking unit is also configured to bake a solid smoking medium to solve the above problems. In the related art, the solid smoking medium is generally directly arranged on a baking cavity, and atomized gas is passed into the solid smoking medium. In this case, it has the following shortcoming: average flow velocity is low, flow velocities are uneven, amount of nicotine released is small, and consumption of the solid smoking medium is great.

The technical problem to be solved by the present disclosure is to provide an improved electronic atomization device, and further to provide an improved smoke-generating assembly.

A technical solution used in the present disclosure to solve its technical problems is: to propose an electronic atomization device, and the electronic atomization device including: a baking unit, defining a baking cavity; a smoke-generating assembly, accommodated in the baking cavity and including: a solid smoking medium; and a flow perturbation member, embedded in the solid smoking medium.

In some embodiments of the present disclosure, the flow perturbation member defines at least one spiral air flow channel; the electronic atomization device further includes a atomization unit, and the atomization unit defines a first air inlet fluidly communicated to outside air; the outside air enters from the first air inlet, passes through the atomization unit and the at least one spiral air flow channel, and contacts with the solid smoking medium; the solid smoking medium is arranged on the at least one spiral air flow channel.

In some embodiments, the atomizing unit is fluidly communicated to the first air inlet and the baking cavity, and the outside air enters from the first air inlet, passes through the atomization unit, enters the at least one spiral air flow channel, and contacts with the solid smoke medium.

In some embodiments, the flow perturbation member is spiral and extends longitudinally in the solid smoking medium.

In some embodiments, the flow perturbation member includes at least one flow perturbation piece arranged spirally, and the at least one flow perturbation piece defines the at least one spiral air flow channel.

In some embodiments, the flow perturbation member includes a plurality of spiral flow perturbation pieces spaced apart from each other and embedded with each other, and a spiral air flow channel is defined between each of two adjacent flow perturbation pieces.

In some embodiments, the flow perturbation member includes a central cylinder, the plurality of spiral flow perturbation pieces are arranged at intervals along an outer circumferential wall of in the central cylinder in a circumferential direction, and each of the flow perturbation pieces extends along an axial direction of the central cylinder.

In some embodiments, the smoke-generating assembly is detachably arranged in the baking cavity, and the smoke-generating assembly further includes an accommodating device configured to accommodate the solid smoking medium.

In some embodiments, the atomization unit and the baking unit are arranged horizontally side by side in the housing; the atomization unit includes an air flow channel, the air flow channel includes the first air inlet and a first air outlet, the first air outlet is located in one side of the atomization unit close to the baking unit, and the first air inlet is located in one side of the atomization unit away from the baking unit; and the baking cavity includes a second air inlet and the second air outlet, and the second air inlet is fluidly communicated to the second air outlet.

In some embodiments, the air flow channel is arranged longitudinally in the atomization unit, and the baking cavity is longitudinally defined in the baking unit.

In some embodiments, the electronic atomization device further includes a communication unit, the communication unit includes a communication channel, and the communication channel is configured to fluidly communicate the first air outlet of the atomization unit to the baking cavity.

In some embodiments, the housing includes a nozzle, the baking unit is cylindrical and arranged longitudinally in the housing, a lower portion of the baking unit is connected to the communication unit, and an upper portion of the baking unit is connected to the nozzle.

In some embodiments, the communication unit includes a third air outlet located on a top and a third air inlet located on a horizontal surface close to one side of the atomization unit; the third air inlet is fluidly communicated to the first air outlet, and the third air outlet is fluidly communicated to the second air inlet.

In some embodiments, the communication unit includes a front half part and a rear half part spliced with the front half part, a surface of the front half part facing the rear half part defines a first arcuate groove, and a cross-section of the first arcuate groove is in shape of a semicircle; a surface of the rear half part facing the front half part defines a second arcuate groove, and a cross-section of the second arcuate groove is in shape of a semicircle; the third air inlet is fluidly communicated to an upper portion of the second arcuate groove, and the third air inlet is fluidly communicated to a lower portion of the second arcuate groove; after the front half part being spliced with the rear half part, the first arcuate groove and the second arcuate groove cooperatively define the communication channel in shape of an arcuate.

In some embodiments, a top of the rear half part further defines a groove, the groove is sleeved on a bottom of the baking unit, and the communication channel is fluidly communicated to the baking cavity.

In some aspects of the present disclosure, a smoke-generating assembly may be disclosed. The smoke-generating assembly is configured for an electronic cigarette, and includes a solid smoking medium; and a flow perturbation member embedded in the solid smoking medium.

In some embodiments, the flow perturbation member defines at least one spiral air flow channel, and the at least one spiral air flow channel extends longitudinally.

In some embodiments, the flow perturbation member is spiral and extends longitudinally in the solid smoking medium.

In some embodiments, the solid smoking medium includes tobacco leaves or tobacco particles, and the solid smoking medium is arranged in the at least one spiral air flow channel.

In some aspects of the present disclosure, an electronic atomization device may be disclosed. The electronic atomization device including: a baking unit; an atomization unit, wherein the baking unit and the atomization unit are arranged side by side along a first direction, and the atomization unit defines an air flow channel arranged along the first direction; and a smoke-generating assembly, accommodated in the baking unit and including: a solid smoking medium; and a flow perturbation member, embedded in the solid smoking medium and defining a spiral air flow passage arranged along a second direction substantially perpendicular to the first direction, wherein the spiral air flow passage is fluidly communicated to the air flow channel; wherein after entering the electronic atomization device, air successfully passes through the air flow channel and the spiral air flow channel, and further contacts with the solid smoking medium.

DETAILED DESCRIPTION

In order to have a clearer understanding of the technical features, objectives and effects of the present disclosure, the specific embodiments of the present disclosure will now be described in detail with reference to the accompanying drawings.

Figure 1:
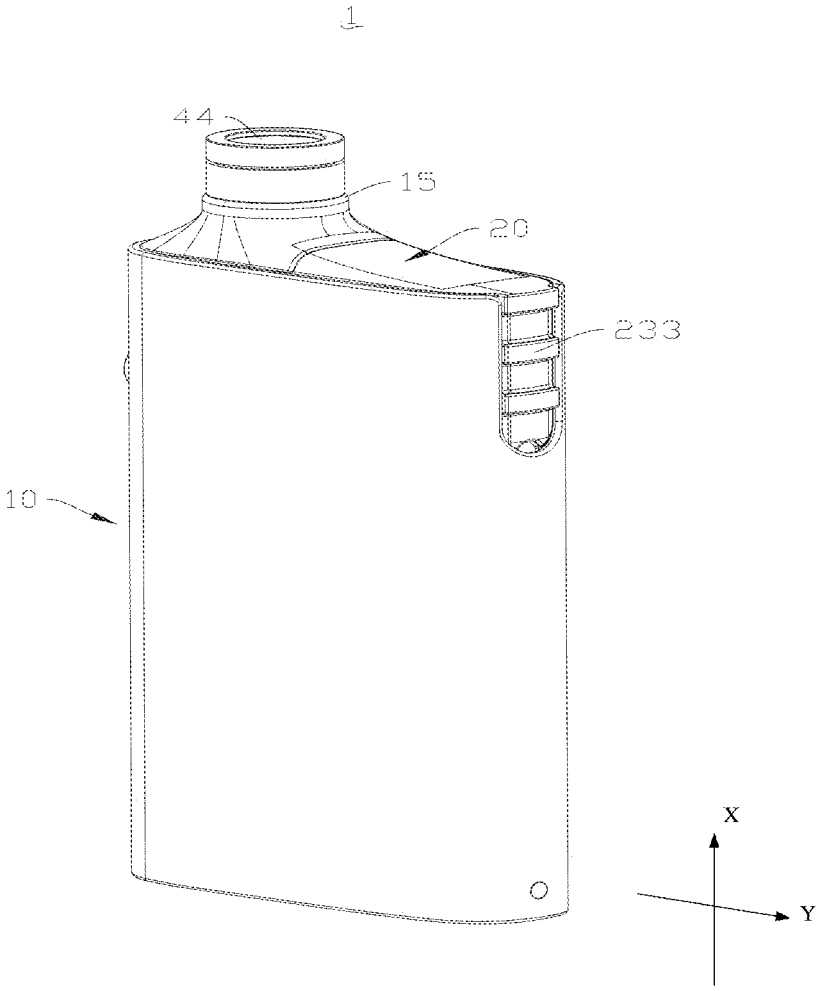
FIG. 1 is a perspective structural schematic view of an electronic atomization device arranged with a solid smoking medium according to an embodiment of the present disclosure.
Figure 2:
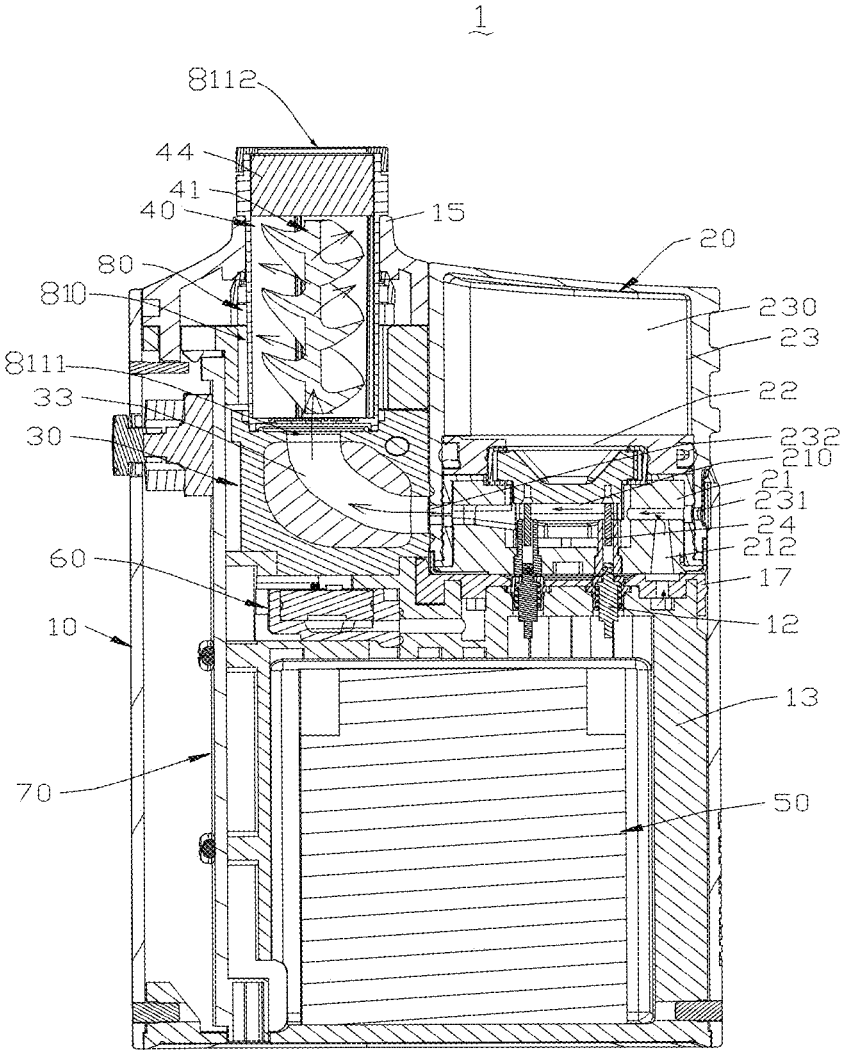
FIG. 2 is a longitudinal cross-sectional view of the electronic atomization device as shown in FIG. 1.

FIGS. 1 to 2 show some embodiments of an electronic atomization device 1 of the present disclosure. As shown in FIGS. 1 and 2, the electronic atomization device 1 may include a housing 10, an atomization unit 20, a baking unit 80, a smoke-generating assembly 40, a power unit 50, an air switch unit 60, a main control unit 70, and a communication unit 30. The atomization unit 20, the baking unit 80, the smoke-generating assembly 40, the power unit 50, the air switch unit 60, the main control unit 70, and the communication unit 30 may be arranged in the housing 10. The atomization unit 20 is configured to atomize liquid medium, such as cigarette liquid, and the like. In some embodiments, it should be appreciated that the atomization unit 20 may be omitted. In this case, the baking unit 80 may bake the smoke-generating assembly 40 to form smoke for a user to inhale. The baking unit 80 is configured to heat a solid smoking medium, such as the smoke-generating assembly 40 (flavor bomb), to form the smoke. The atomization unit 20 and the baking unit 80 are arranged side by side on an upper part of the housing 10. More specifically, the atomization unit 20 and the baking unit 80 are arranged horizontally side by side along a first direction in the upper part of the housing 10. The smoke-generating assembly 40 is arranged on the baking unit 80, and is configured to generate the smoke for the user to inhale when the smoke-generating assembly 40 is baked by the baking unit 80. The power unit 50 is configured to power the atomization unit 20 and the baking unit 80 and arranged on a lower part of the housing 10. Specifically, the power unit 50, the atomization unit 20, and the baking unit 80 are arranged longitudinally inside the housing 10 along a second direction shown in FIG. 1. In some embodiments, the first direction is a direction substantially parallel to an X-axis (as shown in FIG. 1). The second direction is a direction substantially parallel to a Y-axis (as shown in FIG. 1) and perpendicular to the X-axis. The air switch unit 60 is arranged between the baking unit 80 and the power unit 50. The air switch unit 60 is configured to, when driven by an air, control connecting or disconnecting between the power unit 50 and the atomization unit 20 or between the power unit 50 and the baking unit 80. The main control unit 70 is arranged on a side portion of the housing 10, and configured to achieve unlocking, data inputting, controlling, and other functions of the electronic atomization device 1. The communication unit 30 is arranged on a lower part of the baking unit 80, and configured to fluidly communicate the baking unit 80 to the atomization unit 20, so that it is possible that the smoke and an atomizing air are exhausted after the smoke and an atomizing air being mixed with each other, thereby satisfying the user demand Referring to FIGS. 3 and 4, in some embodiments, the atomization unit 20 is detachably arranged in the housing 10, so as to achieve exchange of the atomization unit 20. The power unit 50 includes a battery.

Figure 5:
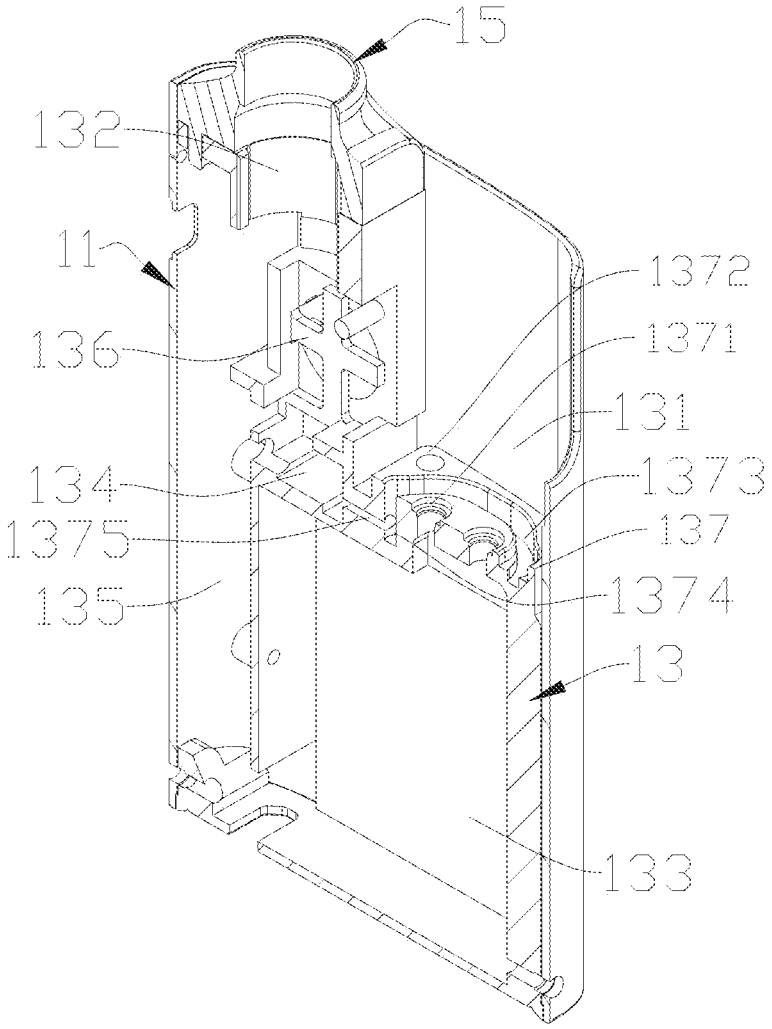
FIG. 5 is a perspective exploded schematic view of a housing of the electronic atomization device as shown in FIG. 1.
Figure 6:
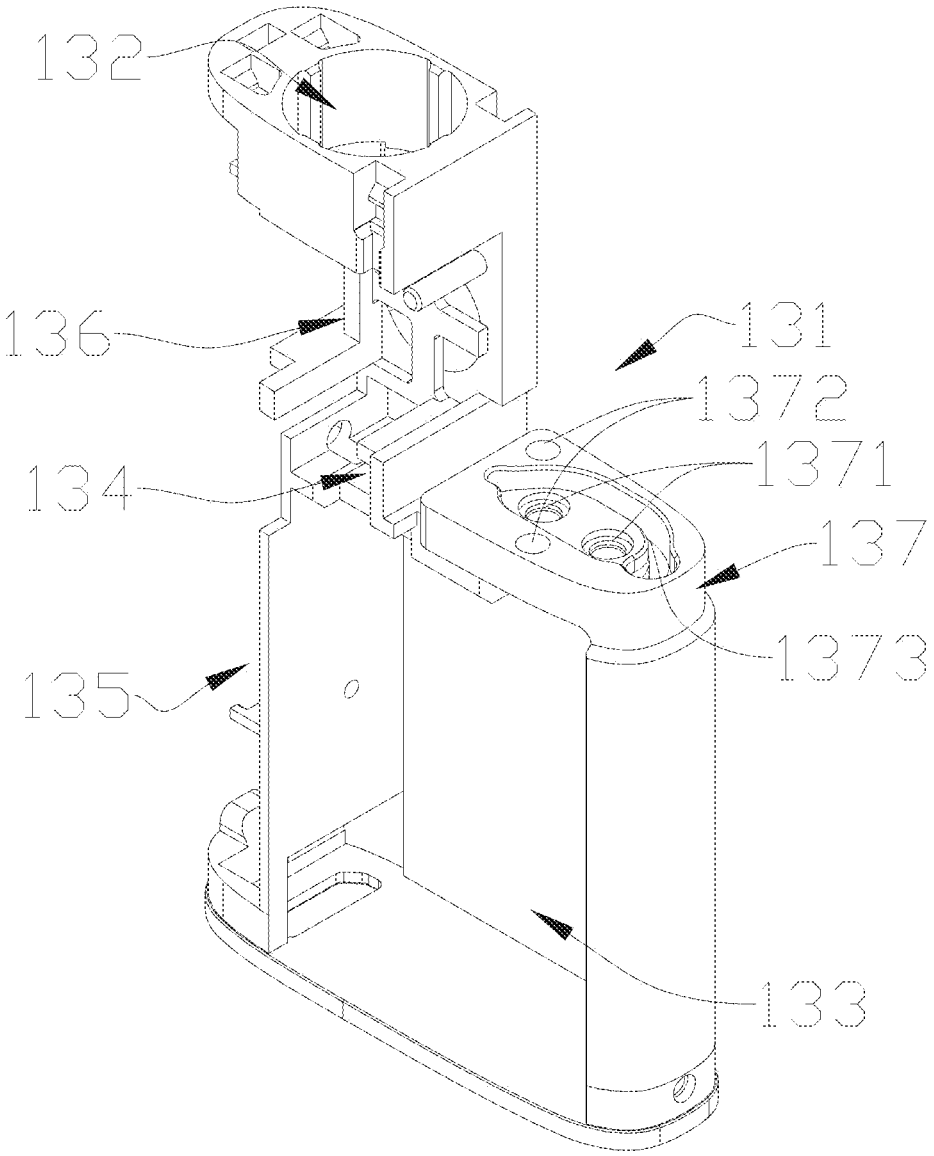
FIG. 6 is a perspective structural schematic view of a support of the electronic atomization device as shown in FIG. 1.

Referring to FIGS. 5 and 6, in some embodiments, the housing 10 may be substantially longitudinal flat. The housing 10 may include a sleeve 11, a support 13 arranged on the sleeve 11, and a nozzle 15 arranged on a top of the support 13. In some embodiments, the sleeve 11 may be substantially longitudinal flat, and is sleeved on a periphery of the support 13. The support 13 is configured for an installation of the atomization unit 20, the power unit 50, the main control unit 70, and the communication unit 30. In some embodiments, the nozzle 15 may be substantially cylindrical, and is configured to the user inhaling the smoke.

In some embodiments, the support 13, the sleeve 11, and the nozzle 15 are integrally formed. The support 13 may include a first accommodating space 131 configured to accommodate the atomization unit 20, a second accommodating space 132 configured to accommodate the baking unit 80, a third accommodating space 133 configured to accommodate the power unit 50, a fourth accommodating space 134 configured to accommodate the air switch unit 60, a fifth accommodating space 135 configured to accommodate the main control unit 70, and a sixth accommodating space 136 configured to accommodate the communication unit 30. A partition wall 137 is defined between the first accommodating space 131 and the third accommodating space 133, and configured to separate the first accommodating space 131 from the third accommodating space 133.

In some embodiments, a top of the partition wall 137 defines a pair of electrode pores 1371, a pair of accommodating holes 1372 configured to receive magnetically attractive elements, and a first arcuate gas-guide groove 1373. The pair of electrode pores 1371 are distributed and spaced apart from each other along a length direction of the partition wall 137. The first arcuate gas-guide groove 1373 may include a first end away from the third accommodating space 133 and a second end close to the third accommodating space 133, and the first arcuate gas-guide groove 1373 extends from the first end a towards the second end. The third accommodating space 133 is located in a distal end of the support 13 away from the nozzle 15. The first accommodating space 131 and the second accommodating space 132 are located in a proximal end of the support 13 close to the nozzle 15. Accordingly, the power unit 50 is located in the distal end far away from the nozzle 15, and the atomization unit 20 and the baking unit 80 are located in the proximal end close to the nozzle 15. In this way, it is possible to make a structure of the electronic atomization device 1 more compact. The partition wall 137 further includes a second gas-guide groove 1374, which is in communication with or fluidly communicated to the second end of the first arcuate gas-guide groove 1373 sunk or recessed downwardly and longitudinally, and a horizontal third gas-guide groove 1375, which is configured to fluidly communicate the second gas-guide groove 1374 to the third accommodating space 133, thereby forming a first air flow channel fluidly communicated to the air switch unit 60. The first gas-guide groove 1373 has an arcuate shape, so that it is possible that a rate of a leakage inflowing the air switch unit 60 is decreased to a certain extent, thereby preventing the leakage from having an adverse effect on the air switch unit 60. In some embodiments, a bottom of the second gas-guide groove 1374 is located at a level lower than a connecting end of the third gas-guide groove 1375 and the second gas-guide groove 1374. In this way, even if the leakage inflows the air switch unit 60, a lower portion of the second gas-guide groove 1374 may accommodate a part of the leakage, thereby further decreasing a possibility of the leakage inflowing the air switch unit 60.

Figure 4:
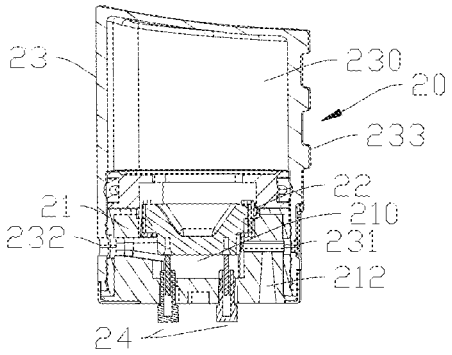
FIG. 4 is a longitudinal cross-sectional view of the electronic atomization device in an exploded state as shown in FIG. 3.
Figure 4:
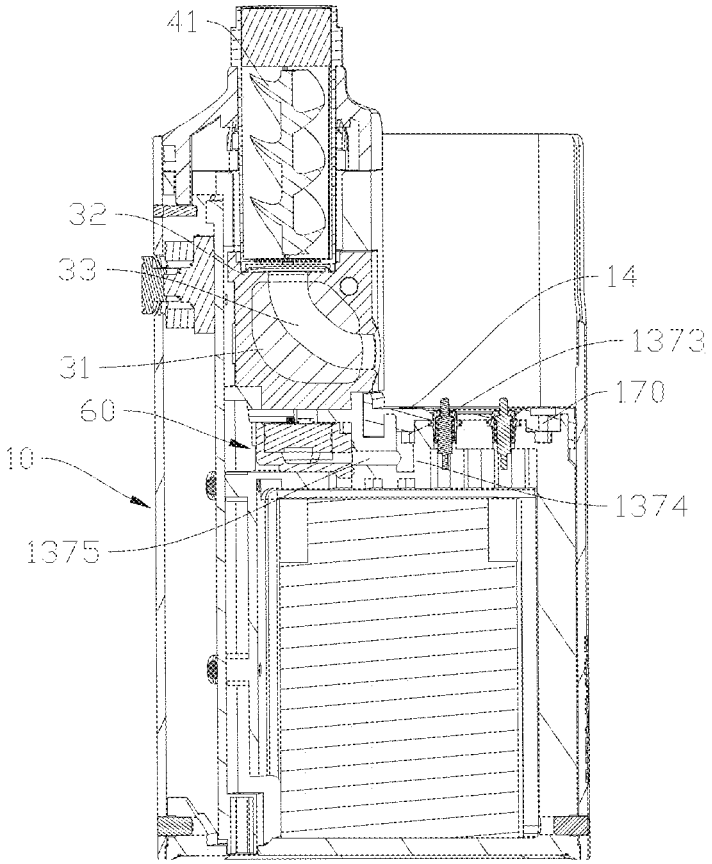

Referring to FIGS. 2, 4, and 5, in some embodiments, the housing 10 further includes a pair of electrode contacts 12, a pair of magnetic attraction members 14, and a sealing cap 17. The electrode contacts 12 is inserted through the electrode pores 1371 and electrically connected to the power unit 50. The magnetic attraction members 14 are embedded in the accommodating holes 1372, so as to attract the atomization unit 20. The sealing cap 17 is configured to cap a top of the partition wall 137, so as to seal the first gas-guide groove 1373. The sealing cap 17 further defines an opening (not shown) configured to expose the electrode contacts 12 and the magnetic attraction members 14. A vent hole 170 is defined on the sealing cap 17, and is fluidly communicated to the first end of the first gas-guide groove 1373. The vent hole 170 is configured to fluidly communicate the first air channel to a gas-guide hole 212 of the atomization unit 20.

Figure 3:
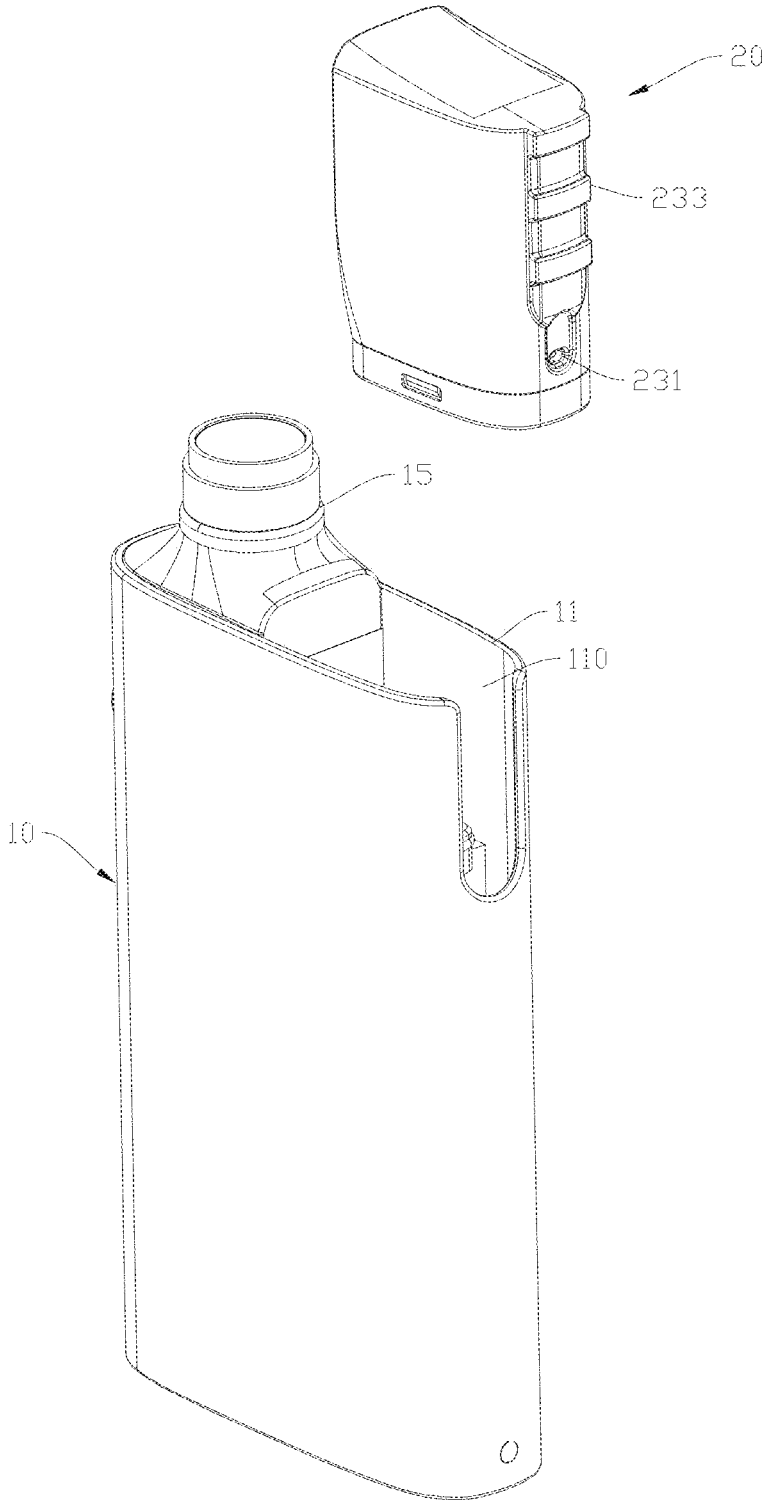
FIG. 3 is a partially exploded perspective schematic view of the electronic atomization device as shown in FIG. 1.

Referring to FIGS. 2 to 4, in some embodiments, the atomization unit 20 may include a base 21, an atomization assembly 22 arranged on the base 21, an atomization shell 23 sleeved on the base 21, and a pair of electrodes 24 electrically connected to the atomization assembly 22. The atomization shell 23 defines a liquid storage cavity 230 configured to accommodate the liquid medium. A top liquid suction surface of the atomization assembly 22 is exposed in the liquid storage cavity 230, and is configured to connect the liquid storage cavity 230 in a liquid conducting manner. The atomization assembly 22 may include a porous body and a heating element arranged on the porous body. The heating element is configured to electrically connect the electrodes 24 via a conductive connection part. The base 21 includes a second air flow channel 210 arranged horizontally, and the second air flow channel 210 is located below the atomization assembly 22. In addition, a bottom atomizing surface of the atomization assembly 22 is exposed in the second air flow channel 210. Two opposite sides of the atomization shell 23, that is, an outer side and an inner side of the atomization shell 23, further define a first air inlet 231 and a first air outlet 232, and the first air inlet 231 and the first air outlet 232 are fluidly communicated to the second air flow channel 210, that is to say, the second air flow channel 210 is provided with two sides, one side of the second air flow channel 210 is fluidly communicated to the first air inlet 231, and another side of the second air flow channel 210 is fluidly communicated to the first air outlet 232. Furthermore, the first air inlet 231 is located a side of the atomization unit 20 away from the baking unit 80, such that outside air is able to enter the second air flow channel 210 and mixed with the atomizing air produced by the atomization assembly 22. The first air outlet 232 is located a side of the atomization unit 20 close to the baking unit 80, such that a mixed air flows out of the atomization unit 20 via the first air outlet 232. The outer side of the atomization shell 23 is arranged with a plurality of convex pushing portions 233, thereby facilitating pushing the atomization unit 20 out of the housing 10. Accordingly, the sleeve 11 of the housing 10 defines a recess 110, and the recess 110 is configured to expose the pushing portions 233. In some embodiments, the base 21 further includes a gas-guide hole 212, one end of the gas-guide hole 212 is fluidly communicated to an end of the second air flow channel 210 close to the first air inlet 231. Another end of the gas-guide hole 212 extends downward a bottom of the base 21, and is configured to be fluidly communicated to the first air flow channel of the support 13. The pair of electrodes 24 is inserted from the bottom of the base 21, electrically connected to the electrode contacts 12, and further electrically connected to the conductive connection part of the heating element of the atomization assembly 22.

In some embodiments, the baking unit 80 is cylindrical and arranged longitudinally in the housing 10. In addition, a lower portion of the baking unit 80 is connected to the communication unit 30, and an upper portion of the baking unit 80 is connected to the nozzle 15. In some embodiments, the baking unit 80 may include a cylindrical heating element and a cylindrical heat conductor coaxially arranged on an inner side of the heating element. The inner side of the heating element form a baking cavity 810 configured to accommodate the smoke-generating assembly 40. The baking cavity 810 defines a second air inlet 8111 arranged on a bottom and a second air outlet arranged 8112 on a top, and the second air inlet 8111 is fluidly communicated to the communication channel 33. Further, the cylindrical heat conductor is arranged on an end of the second air outlet 8112 of the baking cavity 810, and is made of metallic material with high heat conductivity such as copper, aluminium, stainless steel, or the like. The baking unit 80 is configured to heat the solid smoking medium, such as a tobacco, in a low-temperature manner where the solid smoking medium is non-combustion. In this way, due to a low heating temperature, harmful substances produced by means of heating are reduced. In some embodiments, a heating temperature of the baking unit 80 is configured to keep an inner temperature of the solid smoking medium be 40 to 50 degrees Celsius. In some embodiments, the heating temperature of the baking unit 80 may be 45 to 55 degrees Celsius.

Figure 7:
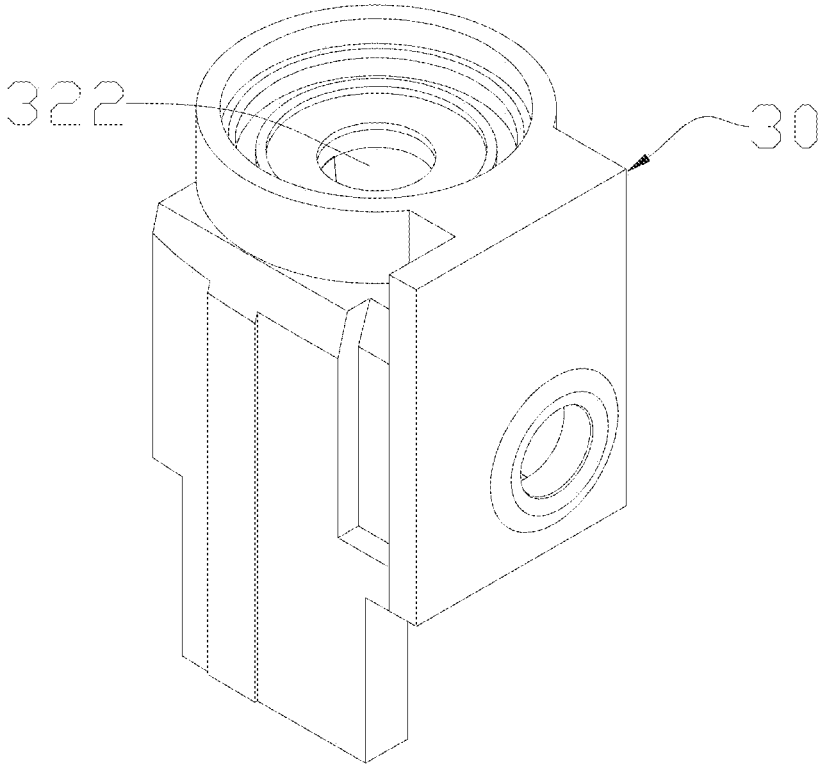
FIG. 7 is a perspective structural schematic view of a communication unit of the electronic atomization device as shown in FIG. 1.
Figure 8:
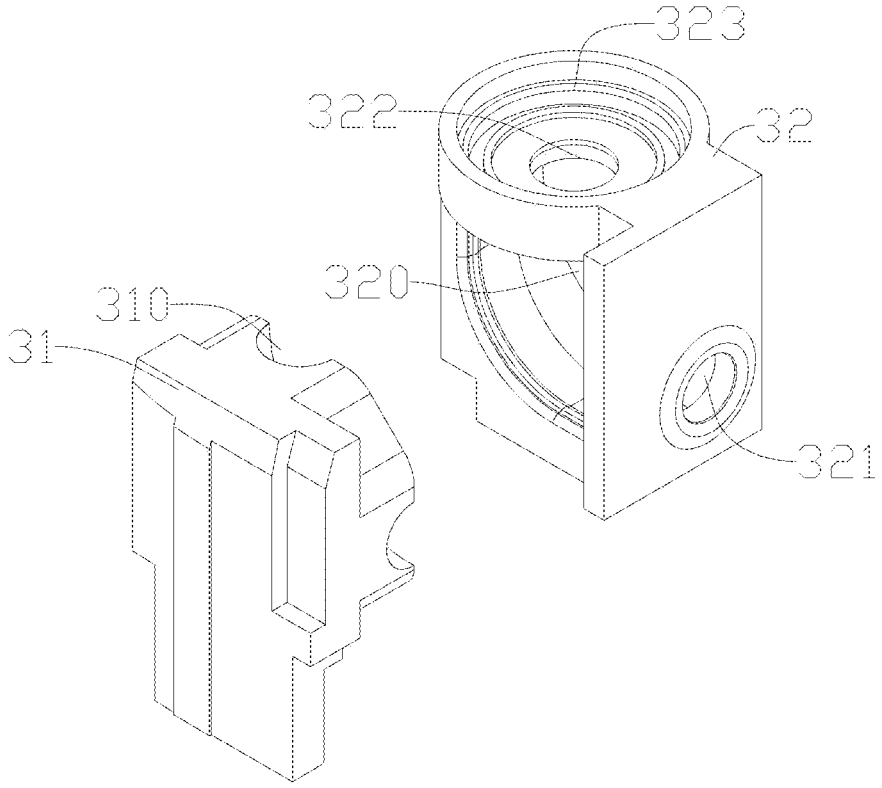
FIG. 8 is a perspective exploded schematic view of the communication unit as shown in FIG. 7.

As shown in FIGS. 7 and 8, the communication unit 30 may include a front half part 31 and a rear half part 32 spliced with the front half part 31. A surface of the front half part 31 facing the rear half part 32 defines a first arcuate groove 310, and a cross-section of the first arcuate groove 310 is in shape of a semicircle. A surface of the rear half part 32 facing the front half part 31 defines a second arcuate groove 320, and a cross-section of the second arcuate groove 320 is in shape of a semicircle. A top of the rear half part 32 further defines a third air outlet 322 fluidly communicated to an upper portion of the second arcuate groove 320. A side of the rear half part 32 adjacent to the atomization unit 20 defines a third air inlet 321 fluidly communicated to a lower portion of the second arcuate groove 320. After the front half part 31 being spliced with the rear half part 32, an arcuate communication channel 33 is formed, and the arcuate communication channel 33 is configured to direct a horizontal airflow into a longitudinal airflow.

As shown in FIG. 2, the communication channel 33 is configured to fluidly communicate the second air flow channel 210 of the atomization unit 20 arranged horizontally to the baking cavity 810 of the baking unit 80 arranged longitudinally. One end of the communication channel 33 is fluidly communicated to the first air outlet 232, and another end of the communication channel 33 is fluidly communicated to the second air inlet 8111. The top of the rear half part 32 further defines a round groove 323, and the round groove 323 is closely sleeved on a bottom of the baking unit 80, so that the communication channel 33 is in a close communication with the baking cavity 810 of the baking unit 80.

Figure 9:
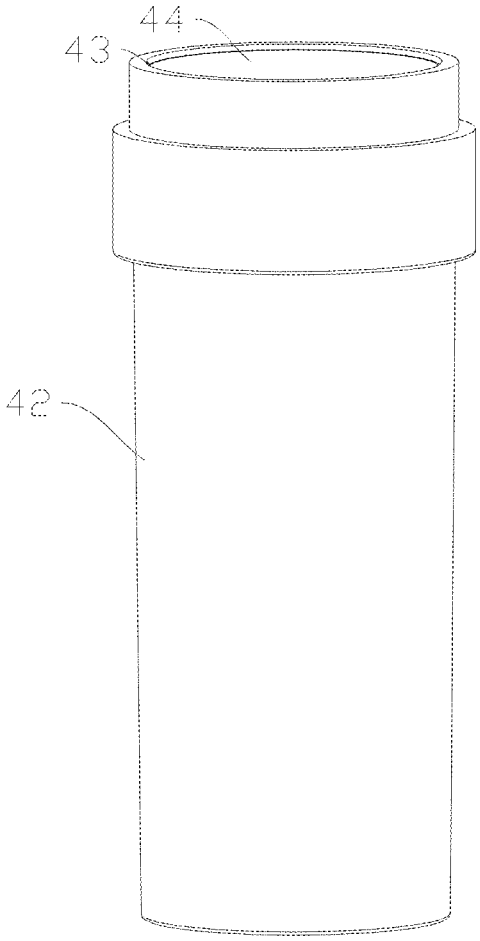
FIG. 9 is a perspective structural schematic view of a smoke-generating assembly of the electronic atomization device as shown in FIG. 1.
Figure 10:
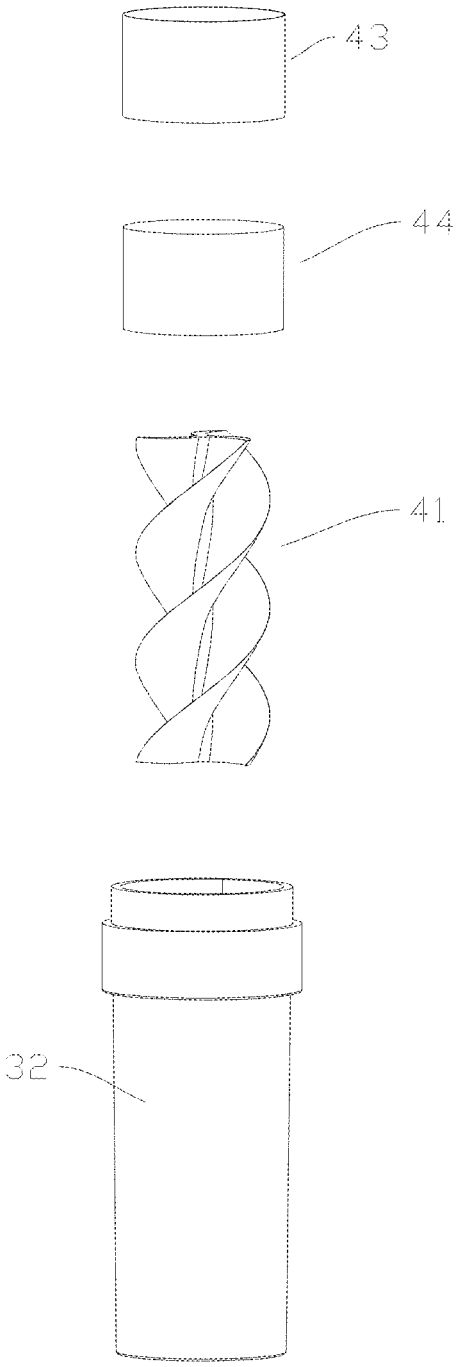
FIG. 10 is a perspective exploded schematic view of the smoke-generating assembly as shown in FIG. 9.
Figure 11:
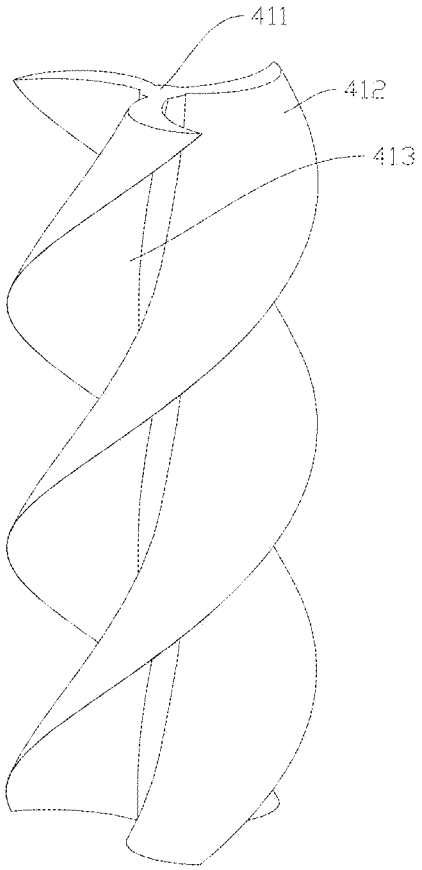
FIG. 11 is a perspective structural schematic view of a flow perturbation member as shown in FIG. 9.

As shown in FIGS. 9 to 11, the smoke-generating assembly 40 may be accommodated in the baking cavity 810 and detachably attached to the baking cavity 810. The smoke-generating assembly 40 may include the solid smoking medium, a flow perturbation member 41, and an accommodating device 42. The solid smoking medium may include tobacco particles or tobacco leaves, and is configured to produce the smoke for the user to inhale in the low-temperature and non-combustion manner. In some embodiments, the solid smoking medium may be columnar. The flow perturbation member 41 may be embedded in the solid smoking medium and arranged longitudinally in the solid smoking medium, such that an average air flow velocity is increased with the perturbing of the flow perturbation member 41, and the velocity uniformity is also improved, thereby making air flow have a sufficient contact with the tobacco leaves, and a convective heat transfer and release and transmission of nicotine are improved.

In some embodiments, the flow perturbation member 41 may be spiral, and extend longitudinally in the solid smoking medium. Furthermore, the flow perturbation member 41 may include a central cylinder 411 and three flow perturbation pieces 412 arranged at intervals. The central cylinder 411 is integrally formed with the flow perturbation pieces 412. In some embodiments, the central cylinder 411 may be omitted. The number of the flow perturbation pieces 412 may be one or a plurality, and is not limited to three. The three flow perturbation pieces 412 may be arranged at intervals along an outer circumferential wall of in the central cylinder 411 in a circumferential direction, each of the three flow perturbation pieces 412 extends along an axial direction of the central cylinder 411. In some embodiments, each of the flow perturbation pieces 412 may be spiral, and defines a spiral air flow channel 413 having a spiral shape. The spiral air flow channel 413 may be arranged between two adjacent flow perturbation pieces 412, and is configured to allow or enable the air to enter the solid smoking medium. Further, the spiral air flow channel 413 may extend longitudinally and be fluidly communicated to the second air flow channel 210. With the spiral air flow channel 413 being arranged spirally, paths of the air are increased or extended, thereby improving the velocity uniformity. In addition, it is possible to increase a contact area of the solid smoking medium contacting with the air, so that the air flow passing through the solid smoking medium may more sufficiently contact with the solid smoking medium, thereby improving the release and the transmission of the nicotine.

As shown in FIGS. 14*a* to 16*b*, in some embodiments, without the flow perturbation member 41, an average flow velocity of a longitudinal section is 0.503 m/s. By arranging with the flow perturbation member, the average flow velocity of the longitudinal section is 0.573 m/s, such that the average velocity of the longitudinal section is increased by 13.9%. Without the flow perturbation member 41, average flow velocities of horizontal sections of sections of the solid smoking medium arranged sequentially along an air flow direction are 0.456 m/s, 0.439 m/s, and 0.395 m/s, respectively. By arranging with the flow perturbation member, the average flow velocities of the horizontal sections of sections of the solid smoking medium arranged sequentially along the air flow direction are 0.539 m/s, 0.539 m/s, and 0.559 m/s, respectively, such that the average velocities of the horizontal sections are increased by 21.5%.

Figure 17A:
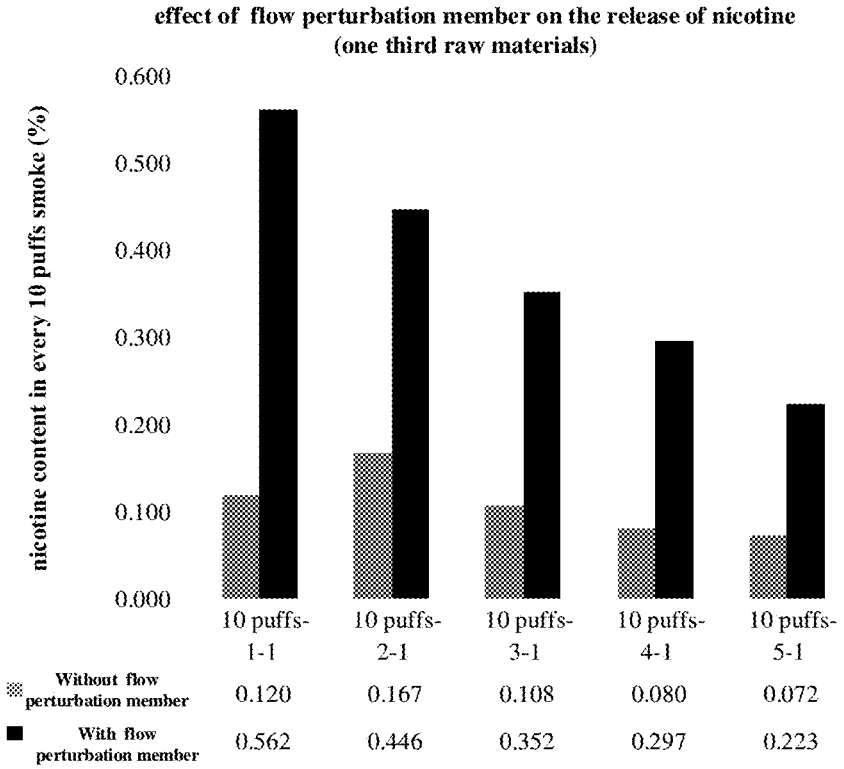
FIG. 17*a* is a comparison diagram of an effect of the flow perturbation member on a release of nicotine (one third raw materials).
Figure 17B:
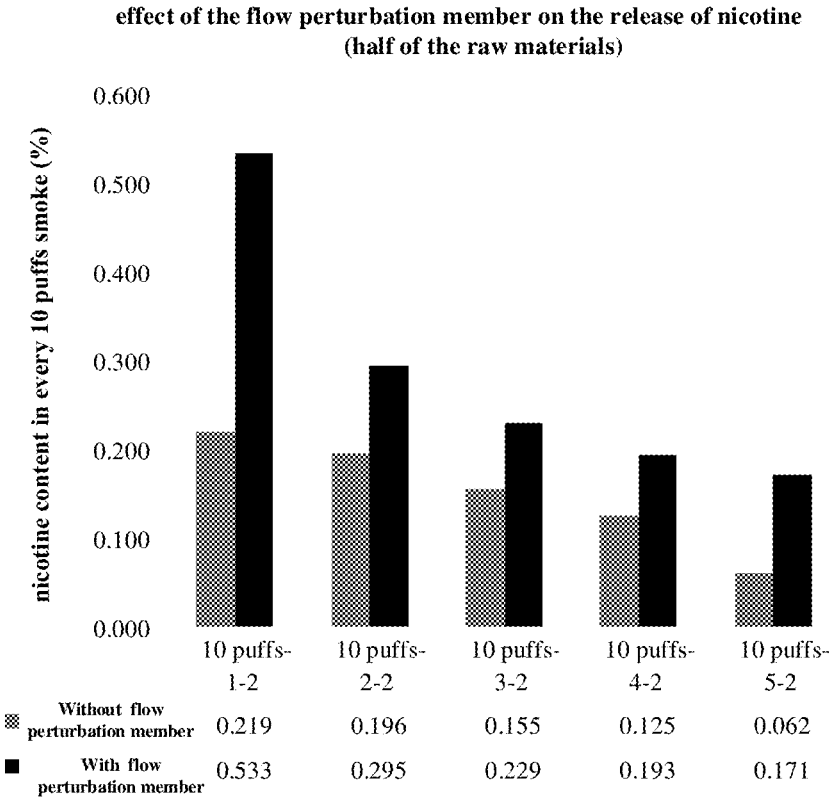
FIG. 17*b* is a comparison diagram of an effect of the flow perturbation member on the release of the nicotine (half of the raw materials).
Figure 17C:
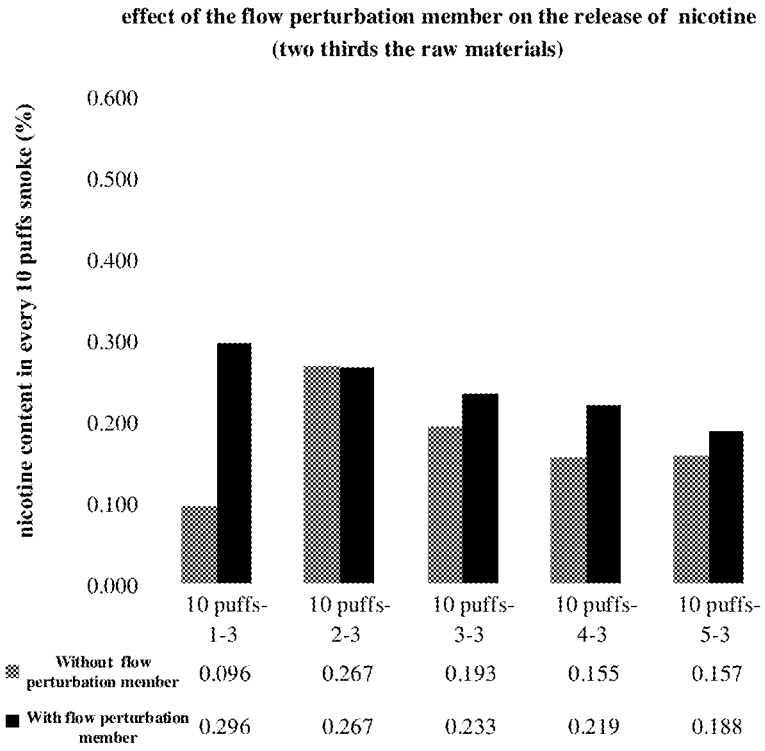
FIG. 17*c* is a comparison diagram of an effect of the flow perturbation member on the release of the nicotine (two thirds the raw materials).

As shown in FIGS. 17*a* and 17*b*, the flow perturbation member 41 can effectively improve the release of the nicotine in raw materials. After adding the flow perturbation member 41, the less the raw materials, the more nicotine is released, and the improvement effect is more obvious. More specifically, by arranging with the flow perturbation member 41, it is possible to make the air flow have sufficient contact with the solid smoking medium, thereby improving a release amount of the nicotine, such that an amount of the raw materials in the solid smoking medium is reduced by two thirds (⅔), and the cost can be greatly reduced.

In some embodiments, the accommodating device 42 may be cylindrical and configured to accommodate the solid smoking medium. In addition, the accommodating device 42 may be a metal sleeve with high heat conductivity. A bottom of the sleeve may define an air inlet, so that the sleeve may be fluidly communicated to the second air flow channel 210, and the air may be allowed or enabled to enter. In some embodiments, it should be understood that the accommodating device 42 may be a wrapping paper wrapped around the solid smoking medium, and is not limited to the sleeve.

In some embodiments, the smoke-generating assembly 40 further includes an installation sleeve 43 arranged in the accommodating device 42 and located in an end close to the nozzle 15, and a filter cotton 44 arranged in the installation sleeve 43. In some embodiments, it should be understood that the installation sleeve 43 may be omitted. The filter cotton 44 is received in the accommodating device 42, and located in an end of the accommodating device 42 close to the nozzle 15. In some embodiments, the filter cotton 44 may be columnar, and configured to filtrate the smoke produced by the solid smoking medium.

Figure 12:
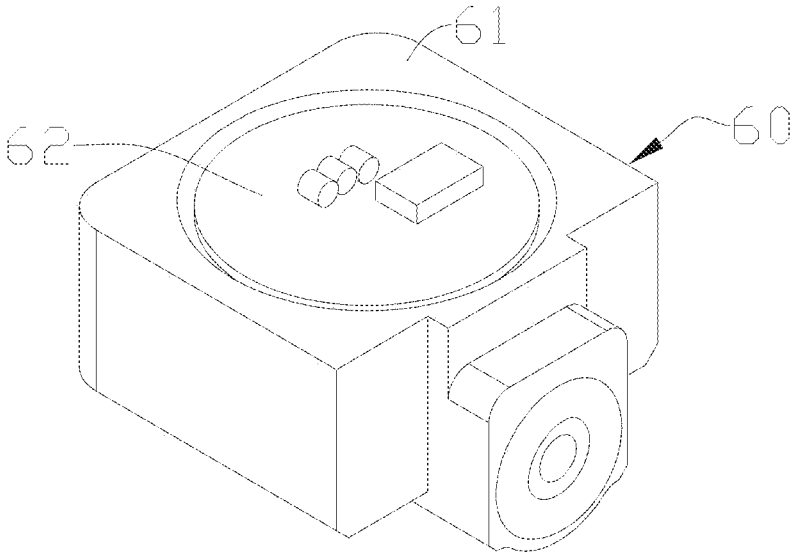
FIG. 12 is a perspective structural schematic view of an air switch unit of the electronic atomization device as shown in FIG. 1.
Figure 13:
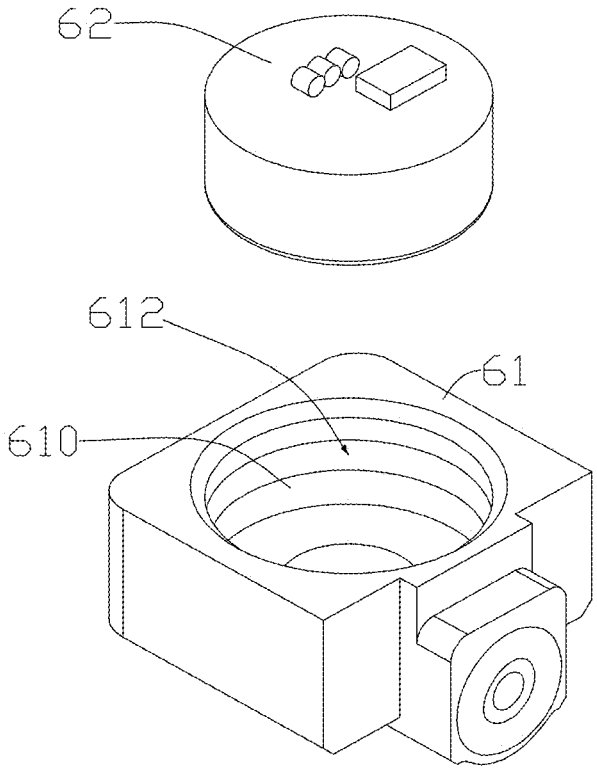
FIG. 13 is a perspective exploded schematic view of the air switch unit as shown in FIG. 12.
Figure 14A:
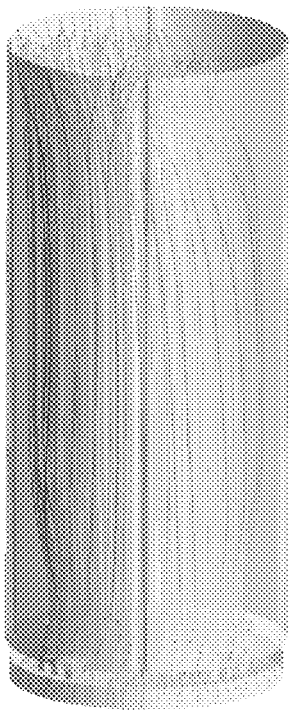
FIG. 14*a* is a schematic view of an air flow direction of the solid smoking medium without the flow perturbation member.
Figure 14B:
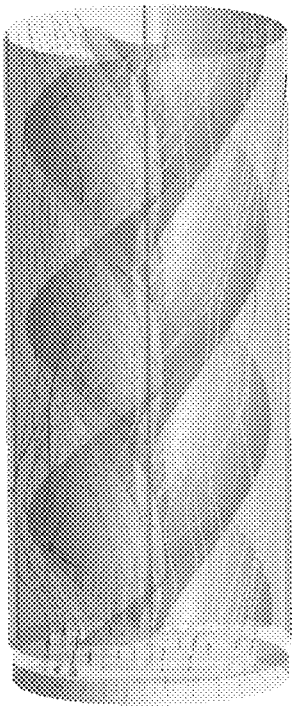
FIG. 14*b* is a schematic view of an air flow direction of the solid smoking medium arranged with the flow perturbation member as shown in FIG. 1.
Figure 15A:
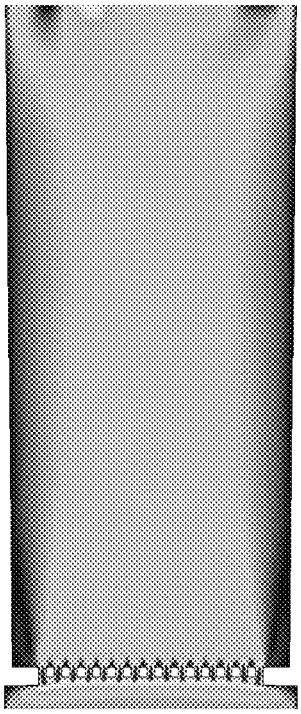
FIG. 15*a* is a longitudinal cross-sectional view of the solid smoking medium without the flow perturbation member as shown in FIG. 14*a*.
Figure 15B:
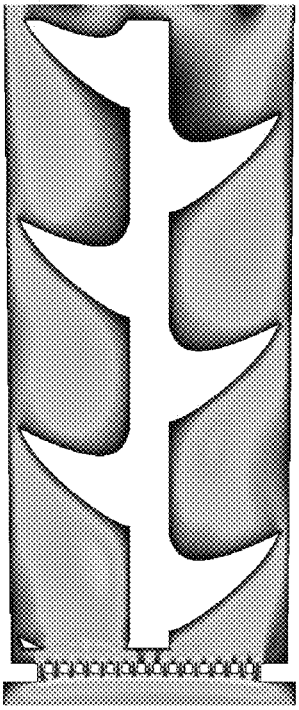
FIG. 15*b* is a longitudinal cross-sectional view of the solid smoking medium arranged with the flow perturbation member as shown in FIG. 14*b*.
Figure 16A:
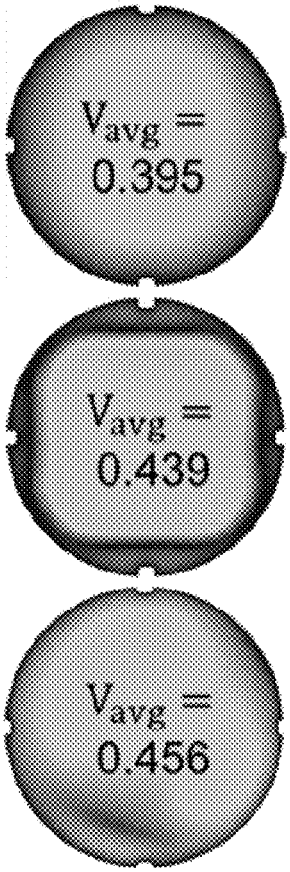
FIG. 16*a* is a horizontal cross-sectional view of flow velocities of each section of the solid smoking medium without the flow perturbation member as shown in FIG. 14*a*.
Figure 16B:
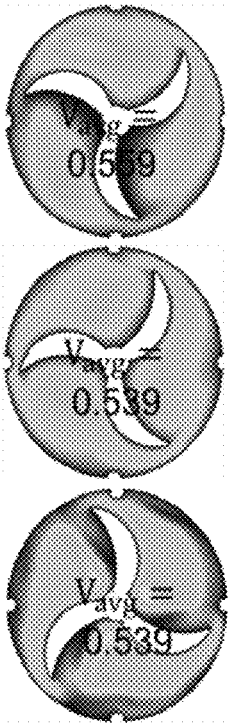
FIG. 16*b* is a horizontal cross-sectional view of flow velocities of each section of the solid smoking medium arranged with the flow perturbation member as shown in FIG. 14*b*.

As shown in FIGS. 12 and 13, in some embodiments, the air switch unit 60 may include an installation base 61, and an air switch 62 installed in the installation base 61. Further, the installation base 61 includes or defines an accommodating cavity 610, and the accommodating cavity 610 defines a top opening at a top. Referring to FIGS. 4 and 5, the air switch 62 is arranged upside down in the top opening, and a gap is defined between a triggering surface at a top of the air switch 62 and a cavity bottom of the accommodating cavity 610. The installation base 61 further includes a communication conduit 612 configured to fluidly communicate the gap to an outer side. The communication conduit 612 is configured to be fluidly communicated to the second air flow channel 210 of the housing 10. In this way, the triggering surface of the air switch 62 may be fluidly communicated to the second air flow channel 210 of the atomization unit 20 via the first air flow channel. Furthermore, in response to an air being inhaled in the second air flow channel 210, a negative pressure is formed in the first air flow channel, such that a negative pressure is formed in the triggering surface of the air switch 62, and the air switch 62 is caused to be in a conducting state. It should be noted that, since the air switch 62 is installed upside down and the gap is formed between the air switch 62 and the cavity bottom of the accommodating cavity 610, the accommodating cavity 610 is not easy to contact with the triggering surface of the air switch 62 even if the leakage inflows the air switch unit 60, thereby further ensuring a normal operation of the air switch 62.

It is to be understood that the above examples only present preferred some embodiments of the present disclosure, and the description is more specific and detailed, but it should not be construed as a limitation on the scope of the present disclosure. It should be noted that for those skilled in the art, the above technical features can be freely combined and several deformations and improvements can be made without departing from the conception of the present disclosure, all of which fall within the scope of the present disclosure. Therefore, all equivalent transformations and modifications made within the scope of the claims of the present disclosure shall fall within the scope of coverage of the claims of the present disclosure.

What is claimed is:

1. An electronic atomization device, comprising:

a nozzle;

a baking unit, defining a baking cavity; and a smoke-generating assembly, accommodated in the baking cavity and comprising:

a solid smoking medium; and a flow perturbation member, embedded in the solid smoking medium;

wherein the electronic atomization device further comprises a communication unit and an atomization unit, the communication unit comprises a third air outlet located on a top and a third air inlet located on a horizontal surface facing one side of the atomization unit and the communication unit further comprises a front half part and a rear half part spliced with the front half part, a surface of the front half part facing the rear half part defines a first arcuate groove, and a cross-section of the first arcuate groove is in a shape of a semicircle;

a surface of the rear half part facing the front half part defines a second arcuate groove, and a cross-section of the second arcuate groove is in a shape of a semicircle;

the third air inlet is fluidly communicated to an upper portion of the second arcuate groove, and the third air inlet is fluidly communicated to a lower portion of the second arcuate groove;

the communication unit comprises a communication channel, after the front half part being spliced with the rear half part, the first arcuate groove and the second arcuate groove cooperatively define the communication channel in a shape of an arcuate.

2. The electronic atomization device of claim 1, wherein the flow perturbation member defines at least one spiral air flow channel, and the atomization unit defines a first air inlet fluidly communicated to outside air; the outside air enters from the first air inlet, passes through the atomization unit and the at least one spiral air flow channel, and contacts with the solid smoking medium; the solid smoking medium is arranged on the at least one spiral air flow channel.

3. The electronic atomization device of claim 2, wherein the atomization unit is fluidly communicated to the first air inlet and the baking cavity, and the outside air enters from the first air inlet, passes through the atomization unit, enters the at least one spiral air flow channel, and contacts with the solid smoking medium.

4. The electronic atomization device of claim 3, wherein the flow perturbation member is spiral and extends longitudinally in the solid smoking medium.

5. The electronic atomization device of claim 4, wherein the flow perturbation member comprises at least one flow perturbation piece arranged spirally, and the at least one flow perturbation piece defines the at least one spiral air flow channel.

6. The electronic atomization device of claim 4, wherein the flow perturbation member comprises a plurality of spiral flow perturbation pieces spaced apart from each other and embedded with each other, and a spiral air flow channel is defined between each of two adjacent flow perturbation pieces.

7. The electronic atomization device of claim 6, wherein the flow perturbation member comprises a central cylinder, the plurality of spiral flow perturbation pieces are arranged at intervals along an outer circumferential wall of in the central cylinder in a circumferential direction, and each of the flow perturbation pieces extends along an axial direction of the central cylinder.

8. The electronic atomization device of claim 1, wherein the smoke- generating assembly is detachably arranged in the baking cavity, and the smoke-generating assembly further comprises an accommodating device configured to accommodate the solid smoking medium.

9. The electronic atomization device of claim 2, wherein the atomization unit and the baking unit are arranged horizontally side by side in a housing;

the atomization unit comprises a second air flow channel, the second air flow channel comprises the first air inlet and a first air outlet, the first air outlet is located in a first side of the atomization unit, and the first air inlet is located in a second side of the atomization unit, the first side of the atomization unit is nearer to the baking unit than the second side thereof; and the baking cavity comprises a second air inlet and a second air outlet, and the second air inlet is fluidly communicated to the second air outlet.

10. The electronic atomization device of claim 9, the second air flow channel is arranged longitudinally in the atomization unit, and the baking cavity is longitudinally defined in the baking unit.

11. The electronic atomization device of claim 10, the communication channel is configured to fluidly communicate the first air outlet of the atomization unit to the baking cavity.

12. The electronic atomization device of claim 11, wherein the housing comprises a nozzle, the baking unit is cylindrical and arranged longitudinally in the housing, a lower portion of the baking unit is connected to the communication unit, and an upper portion of the baking unit is connected to the nozzle.

13. The electronic atomization device of claim 12, wherein the third air inlet is fluidly communicated to the first air outlet, and the third air outlet is fluidly communicated to the second air inlet.

14. The electronic atomization device of claim 1, wherein a top of the rear half part further defines a round groove, the round groove is sleeved on a bottom of the baking unit, and the communication channel is fluidly communicated to the baking cavity.

15. An electronic atomization device, comprising:

a baking unit, defining a baking cavity;

an atomization unit, wherein the baking unit and the atomization unit are arranged side by side along a first direction, and the atomization unit defines an air flow channel arranged along the first direction; and a smoke-generating assembly, accommodated in the baking unit and comprising:

a solid smoking medium; and a flow perturbation member, embedded in the solid smoking medium and defining a spiral air flow passage arranged along a second direction substantially perpendicular to the first direction, wherein the spiral air flow passage is fluidly communicated to the air flow channel;

wherein after entering the electronic atomization device, air successfully passes through the air flow channel and the spiral air flow channel, and further contacts with the solid smoking medium;

wherein the electronic atomization device further comprises a communication unit, the communication unit comprises a third air outlet located on a top and a third air inlet located on a horizontal surface facing one side of the atomization unit and the communication unit further comprises a front half part and a rear half part spliced with the front half part, a surface of the front half part facing the rear half part defines a first arcuate groove, and a cross-section of the first arcuate groove is in a shape of a semicircle;

a surface of the rear half part facing the front half part defines a second arcuate groove, and a cross-section of the second arcuate groove is in a shape of a semicircle;

the third air inlet is fluidly communicated to an upper portion of the second arcuate groove, and the third air inlet is fluidly communicated to a lower portion of the second arcuate groove;

the communication unit comprises a communication channel, after the front half part being spliced with the rear half part, the first arcuate groove and the second arcuate groove cooperatively define the communication channel in a shape of an arcuate.

* * * * *